US006106387A

United States Patent [19]

Smith

[11] Patent Number: 6,106,387

[45] Date of Patent: Aug. 22, 2000

[54] CONDITIONED AND CONTROLLED AIR VESTIBULE FOR REFRIGERATED WAREHOUSE

[76] Inventor: George R. Smith, Box 4131 Hwy. 87E, Milepost 90, Lilliston, Mont. 59457

[21] Appl. No.: 09/250,222

[22] Filed: Feb. 13, 1999

[51] Int. Cl.[7] ..... F24F 9/00

[52] U.S. Cl. ..... 454/190; 454/191; 454/192

[58] Field of Search ..... 454/188, 190, 454/191, 192

[56] References Cited

U.S. PATENT DOCUMENTS 2,775,187 12/1956 McClurkin ..... 454/190
3,143,952 8/1964 Simons ..... 454/190
3,207,056 9/1965 Flebu ..... 454/190
3,282,193 11/1966 Jennings ..... 454/191
3,331,303 7/1967 Gladd et al. ..... 454/188

*Primary Examiner*—Harold Joyce
*Assistant Examiner*—Andrea M. Joyce
*Attorney, Agent, or Firm*—Roger W. Jensen

[57] ABSTRACT

An improved, low-cost conditioned air vestibule for use on a doorway of a refrigerated storage room permits unobstructed passage of vehicles while effectively reducing the exchange of air through the doorway and substantially eliminating precipitation both inside and outside the doorway.

5 Claims, 10 Drawing Sheets

Two Air Curtains with Heating and Cooling Source

Coventional Door Only
-OPEN / CLOSE OPERATION-

Psychonmetric Chart (not to scale)

LEGEND $M_S$ Supply Duct or Manifold $M_R$ Return Duct or Manifold

Heavy Arrows — Primary Airflow

Light Arrows — Secondary Airflow

Two Air Curtains with Heating and Cooling Source

INTAKE-AIR ASSEMBLY

CONDITIONED AND CONTROLLED AIR VESTIBULE FOR REFRIGERATED WAREHOUSE

BACKGROUND OF THE INVENTION

1. Field of the Invention

This invention relates to apparatuses for controlling the exchange of air through doorways or other openings to refrigerated spaces, and more particularly to an improved conditioned air vestibule for use at a doorway of a refrigerated or cold storage room.

2. Description of the Prior Art

Doors provide access to cold storage rooms from anterooms or loading docks or other adjacent spaces for material handling vehicles and pedestrian traffic. Traffic through the doors is frequently heavy particularly at peak periods of the day so that the doorways are necessarily open at least a substantial portion of the time and many are kept open continuously during such peak traffic periods. Such open doorways present problems both with regard to operation and maintenance of refrigeration equipment and with regard to the productivity and safety of the facility.

As is recognized, an open doorway to a refrigerated space permits the heavier refrigerated air to flow out of the refrigerated space through the lower half of the opening and an equal mass of warm humid air to flow inward through the upper half. In this air exchange, warm air entering the refrigerated space is referred to in the industry as infiltration air, and cold air escaping is sometimes referred to as exfiltration air.

When a warm air mass encounters a cold air mass, precipitation commonly occurs, the eventuality of this phenomenon depending upon conditions of the two air masses relative to one another. The form of precipitation, i.e., water droplets or airborne ice crystals, depends upon the temperature of the mixture.

The warm and cold side conditions at the entrance to subfreezing cold storage rooms or freezer rooms are generally in the precipitation range relative to each other, at least during mild and warmer weather, and almost always in the warmer climates. As warm air enters through the top of a freezer room door, precipitation in the form of airborne ice crystals is visible as haze while visible fog frequently appears outside the door as cold air escapes from the bottom of the door and mixes with the warm humid outside air. Warm side fog can obstruct the vision of personnel, including vehicle operators, working in the area. In addition, the chilled fog-laden air frequently causes wet slippery floors in the vicinity of the doorway with consequent hazards not only to personnel but also to equipment and material.

Precipitation from infiltration air is generally found to be even more objectionable than fog outside the door. The airborne ice crystals result in frost or snow accumulation on ceilings, walls, and freezer room appurtenances as well as on products stored in the room. Such frost frequently grows to many inches in thickness and can result in snow droppings which cause icy floors and present extremely slippery and hazardous conditions for forklift trucks. Further, the airborne ice crystals may be drawn into the refrigeration equipment and produce premature clogging of the coils, as compared with normal evaporator coil icing, thereby reducing the refrigeration effect and adding coil defrosting burden. The result is a substantial reduction in refrigeration efficiency and may require installation of additional evaporator coils or oversized refrigeration equipment.

Many attempts have been made to reduce the air exchange at open refrigerated warehouse doors. One approach has been to employ an air curtain across the door, with the forced flow of relatively high velocity air across the opening serving to restrict the normal air exchange resulting from the temperature differential. It is also known to condition air used in such air doors by heating the air employed in the air curtain to reduce precipitation both inside and outside the refrigerated space. Examples of such devices may be found, for example, in U.S. Pat. Nos. 3,218,952, 3,817,160, 4,516,482 and U.S. Pat. No. Des. 264,561.

A relatively short conditioned air vestibule having two spaced air curtain doors employing conditioned air in the air curtain is illustrated in U.S. Pat. No. Des. 140,200. Such devices, while effective in reducing precipitation both inside and outside a refrigerated warehouse door, they don't eliminate such precipitation.

Physical barriers, particularly the well-known strip doors, are also widely used to restrict the flow of air through an open refrigerated warehouse door. Such strip doors employ transparent vinyl strips which enable personnel and vehicles to push through, with the strips quickly falling back into place to act as an air flow barrier when the obstruction has cleared the door.

Another known system for controlling precipitation from infiltration or exfiltration air employs a step-down room at the door, with the step-down room having a physical barrier such as a strip door or rigid push-through door at each end for restricting air exchange. The air inside such step-down rooms is heated to a non-fogging or non-frost producing level and to prevent airborne crystal formation in the refrigerated room as a result of air infiltration. This level of heat is normally found sufficient to prevent fog formation as a result of air exfiltration from the step-down room. The known step-down rooms are of sufficient size to permit material handling vehicles to enter one end and the door to close behind it before reaching and pushing through the door at the other end. Such arrangements are therefore costly both because they occupy substantial floor space and because of the relatively large volume of heated air required.

Large step-down rooms also have generally been considered objectionable in that their tunnel configuration tends to restrict the vision of forklift operators and therefore can present a safety hazard. For this reason, it has been common practice to provide two step-down rooms to enable one way traffic entering and leaving the cold storage room.

The use of push through strip doors is also objectionable in that the strips tend to become less transparent with use and may present an obstruction to vision. Further, frost or fog condensation on the strip surfaces not only obstruct vision, but the wet, cold surfaces are generally considered objectionable by personnel passing through the door. The relatively heavy plastic strips can also drag lightweight items such as empty cartons from material handling equipment.

SUMMARY OF THE INVENTION

It is a primary object of the present invention to provide an efficient, effective and energy conserving conditioned air vestibule which is operable to control air exchange through a cold storage room door and which overcomes many of the defects of the prior art apparatus.

Another object is to provide such a conditioned air vestibule which may be installed on either the warm side or the cold side of existing cold storage room doors and which is operable to greatly reduce the flow of infiltration air into and exfiltration air out of cold rooms.

Another object is to provide such a conditioned air vestibule which occupies a minimum of floor space and which may safely be used for two way traffic through the cold storage room door.

Another object is to provide such a conditioned air vestibule including means for conditioning air within the vestibule so that any airflow through the vestibule will not result in precipitation.

Another object is to provide such a conditioned air vestibule which is effective in maintaining all see-through and other surfaces of the vestibule clear of frost and moisture.

Another object is to provide such a conditioned air vestibule which is economical to operate and which requires a minimum of maintenance.

The foregoing and other objects and advantages of the invention are achieved in a first preferred embodiment wherein multiple air-curtain apparatuses for controlling and conditioning the flow of air through an opening in a vertical wall of a cold storage room comprises at least three air curtain units arranged in aligned, spaced-apart and substantially parallel relationship to form a vestibule positioned adjacent to and in register with said opening. Each of said units comprises (1) first and second vertically oriented air manifold members respectively positioned adjacent the sides of said opening and extending from the bottom to the top of said opening, said first manifold member being an air discharge means including longitudinally-disposed, laterally-positionable directional blades arranged from top to the bottom thereof, and said second manifold member being an air return means and having air inlet means disposed from the top to the bottom thereof, and (2) air transport means including air blower means connected to said first manifold member and adapted to supply pressurized air thereto, and further including air return means connecting said second manifold member to inlet means of said blower means. The air curtain units are arranged so that their respective first manifold members are proximate or adjacent to the second manifold members of the next adjacent air curtain units and the blades of said first manifold members are preselectively sized and set or directed as follows:

i) said blades at the top of said first manifold members are sized and are set at a preselected maximum discharged air momentum countering relatively warm and moist air flow through said opening into said room;

ii) said blades at the bottom of said first manifold members are sized and are set at a preselected maximum orientation toward said cold storage room to provide maximum discharged air momentum countering relatively heavy cold air from said room through said opening; and iii) said blades, on a preselected graduated basis, are sized and set so that the blades, at a preselected intermediate position, have (1) an orientation parallel to said opening and toward said second manifold members; and (2) a reduced preselected discharged air momentum.

The above-described first embodiment provides significant improvements in performance over all known prior art arrangements.

A second preferred embodiment of the invention yields even greater economy of operation by adding a heating function to one of the air curtain units. This aspect of the invention is relevant to vestibules comprising three or more air curtains.

A third preferred embodiment yields even greater economy of operation; this embodiment combines at least two air curtains in a vestibule with one of the air curtains discharging heated air and another of the air curtains discharges cooled air.

BRIEF DESCRIPTION OF THE DRAWINGS

Other features and advantages of the invention will be apparent from the detailed description contained hereinbelow, taken in conjunction with the drawings, in which:

FIG. 2 is an isometric showing of a prior art discharge air assembly which may be used with the apparatus shown in FIG. 1;

FIG. 2*a* is an enlarged view of the air straightener used in FIG. 2;

FIGS. 3, view A—A, view B—B, and view C—C are views of FIG. 3 as viewed along section lines A—A, B—B and C—C;

FIG. 16*a* shows the vestibule within the freezer room and abutting the opening;

FIG. 16*b* shows the vestibule positioned in the opening and having portions in both the anteroom as well as the freezer;

FIG. 16*c* shows the vestibule positioned in the anteroom in register with and abutting the wall opening;

DETAILED DESCRIPTION OF THE PREFERRED EMBODIMENTS

Figure 1:
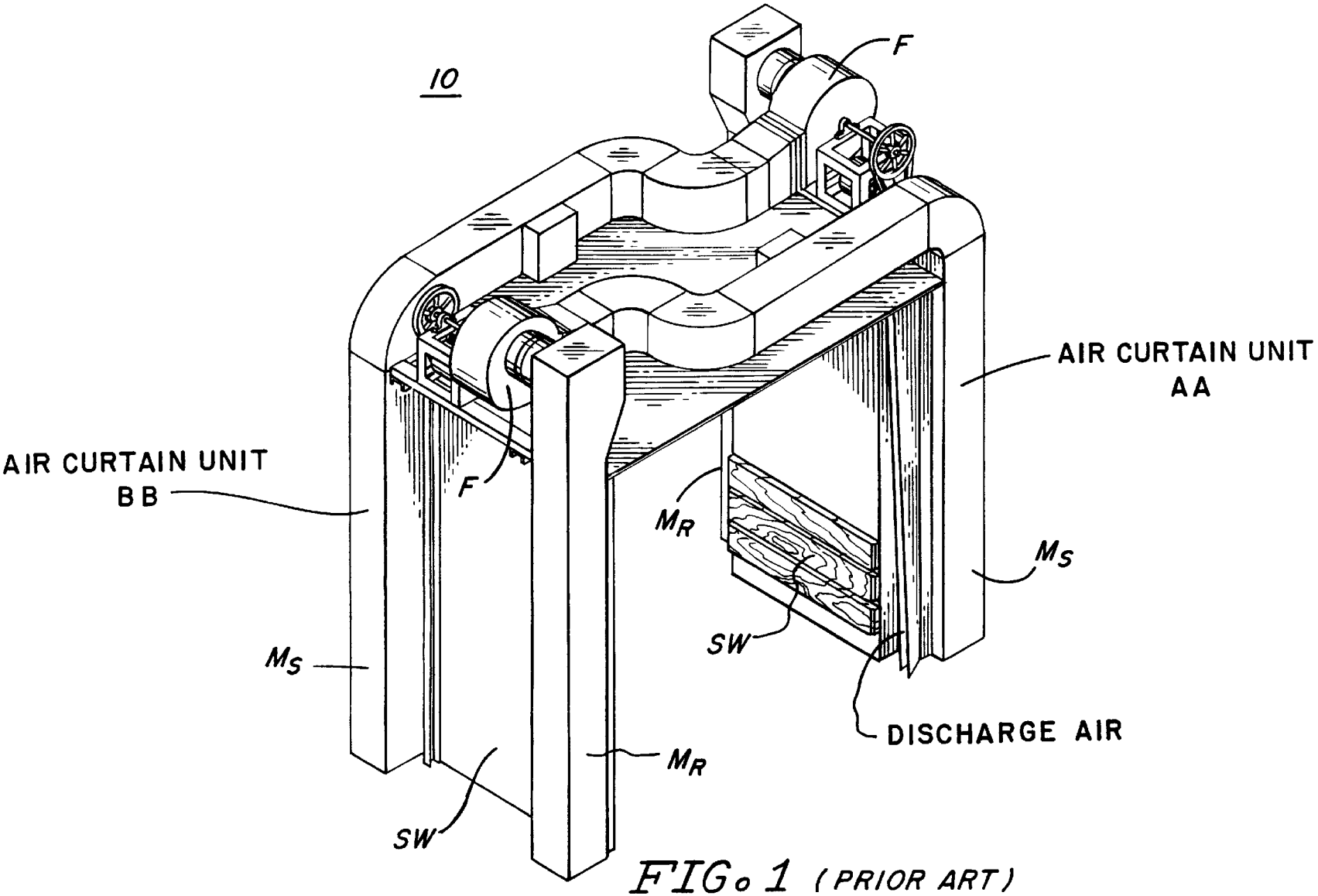
FIG. 1 (PRIOR ART)
FIG. 1 is an isometric drawing of a prior art double-curtain conditioned air vestibule.

FIG. 1 is a prior art showing of a pair of air curtains configured as a vestibule, i.e., air curtain unit M and air curtain unit BB, each comprising first and second vertically oriented air manifold members, i.e., air discharge ducts or supply manifolds $M_S$ and air return ducts or manifolds $M_E$. The units AA and BB are shown spaced apart with sidewall means SW positioned therebetween to prevent lateral air from entering the vestibule. Each of the air curtain units has associated therewith a fan or blower means F positioned on top of the structure, adapted to receive air from the return ducts or manifolds $M_R$ and to supply air under pressure to the supply manifolds $M_S$.

Figure 3:
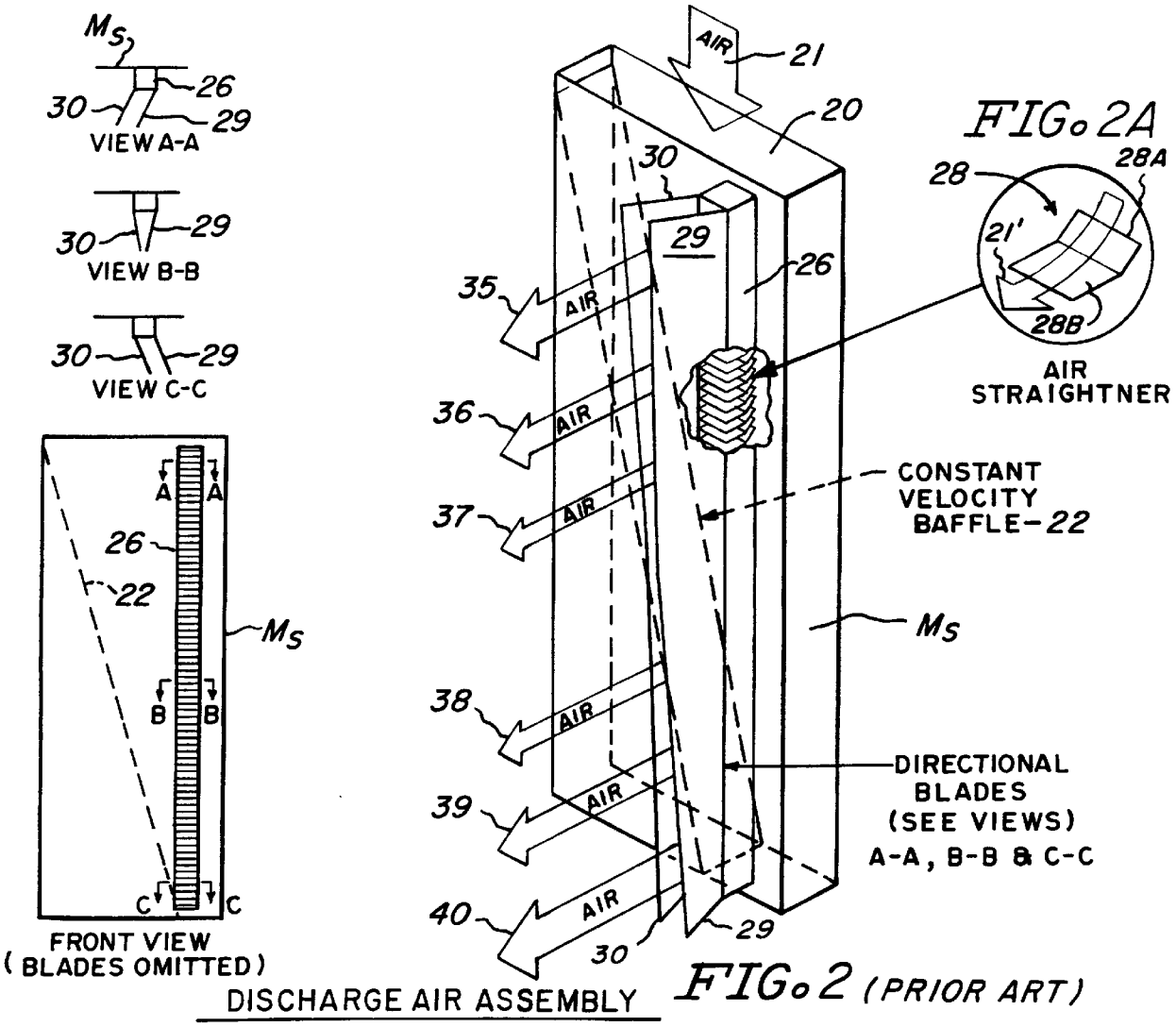
FIG. 3 (PRIOR ART)
FIG. 3 is a front elevation view, on a smaller scale, of the device shown in FIG. 2.

FIG. 2 shows a prior art discharge air assembly or manifold $M_S$; the assembly is an elongated rectangular duct or plenum having a top opening 20 receiving pressurized air 21 from a motor driven blower or fan F (see FIG. 1). A constant velocity baffle 22 positioned within the plenum extends from the upper left hand corner diagonally downward at an angle to a bottom intermediate position as shown. The discharge air assembly further includes a housing 26 for a plurality of air straighteners 28, the air straighteners being shown in greater detail in FIG. 2A. The air straighteners 28 comprise a slanted upwardly portion 28A adapted to be impacted by the air 21 moving vertically down as shown in FIG. 2 and a air straightener horizontal portion 28B; the function of the air straighteners is to systematically, and with minimum air turbulence, capture the vertically moving air 21 and have it discharged out of assembly $M_S$ on a horizontal basis as is depicted in FIG. 2A. A pair of directional blades 29 and 30 extend longitudinally from the top to the bottom of the housing 26, and are preset at a preselected orientation by suitable means such as brackets (not shown) to achieve the orientation shown in FIG. 3AA, FIG. 3BB and FIG. 3CC. More specifically, it will be noted that, as viewed in FIG. 2, the tops of the blades 29 and 30 are angled to the left side of unit $M_{S.}$, while the bottom ends of 29 and 30 are angled to the right. It should further be noted that the blades 29 and 30 are spaced apart at the top and at the bottom a greater amount than the spacing at the midpoint or preselected intermediate point; the purpose of this is to provide a variation in the momentum of the air flowing through the blades. This is depicted in FIG. 2 by schematic air vectors 35–40. The width of the shaft of the arrows is intended to be indicative of the magnitude of the momentum of the air. Thus, for example, air vectors 35 and 40 at the top and bottom, respectively, of the assembly, have the largest air momentum; vectors 36 and 39 are of intermediate values of momentum; and vectors 37 and 38, which are closest of the middle or center of the assembly, are of the smallest air momentum.

Figure 18:
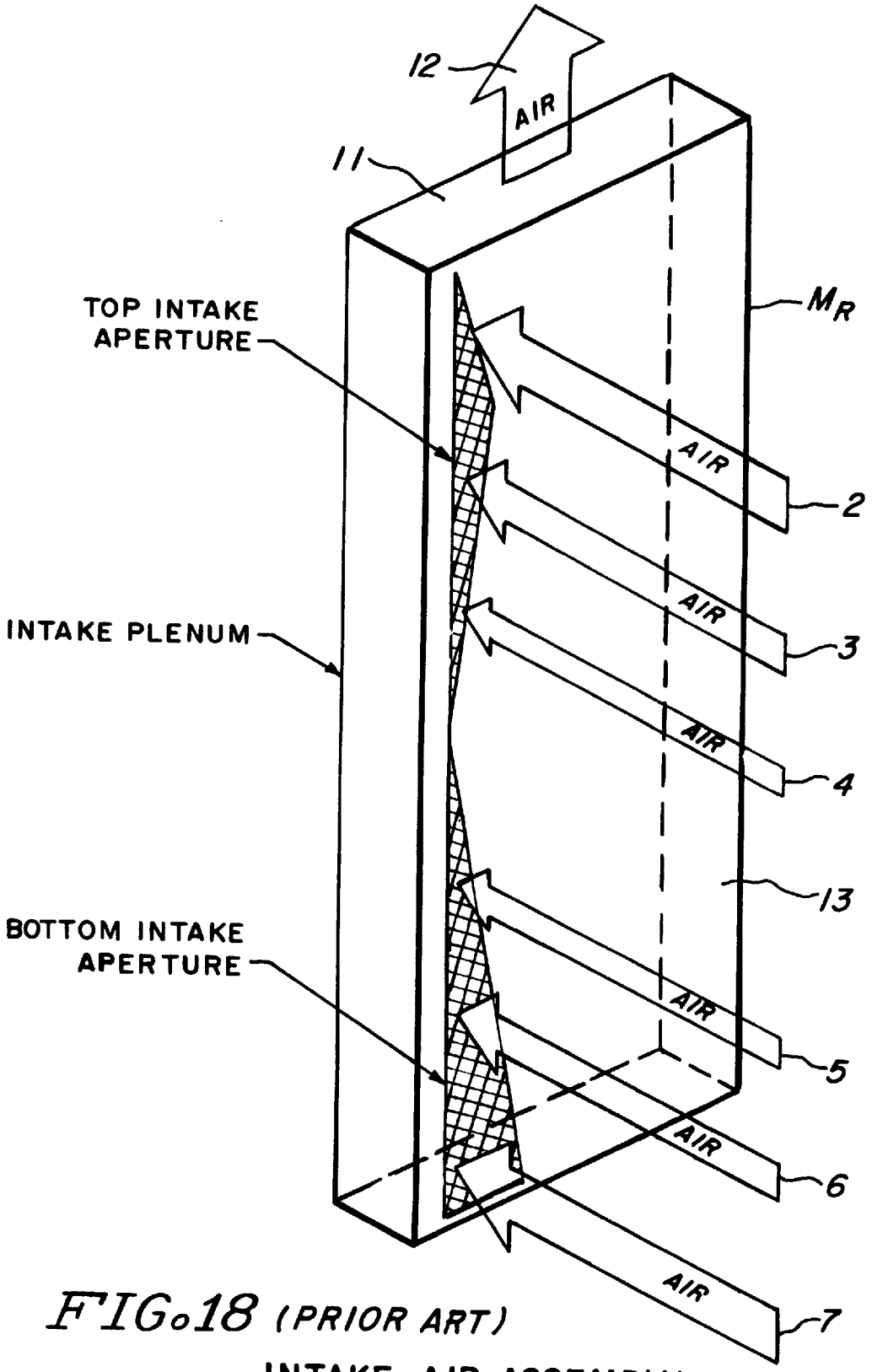
FIG. 18 (PRIOR ART)
FIG. 18 is an isometric showing of a prior art intake-air assembly which may be used with the air curtain units shown in FIG. 1.

FIG. 18 shows a prior art return or intake air assembly, or manifold $M_R$; the assembly is an elongated rectangular duct or plenum having a top opening 11 adapted to being connected to the intake of fan F (see FIG. 1); the total air return is represented by the vector 12.

Manifold $M_R$ has an inward-facing side 13 with top and bottom characterized air intake apertures 14 and 15; the characterization being preselected to cause the air flow into $M_R$ to substantially match the airflow from the discharge or supply manifold $M_S$, it being understood that the airflow from MS is horizontally, or laterally across the vestibule to $M_R$. Thus, in FIG. 18 the intake momentum vectors are identified by reference numerals 2, 3 and 4 (on the top) and 5, 6 and 7) on the bottom; vectors 2 and 7 on the top and bottom, respectively, are the largest; vectors 4 and 5 closest to the middle are the smallest; and intermediate vectors 3 and 6 represent air momentum of intermediate values.

Figure 4:
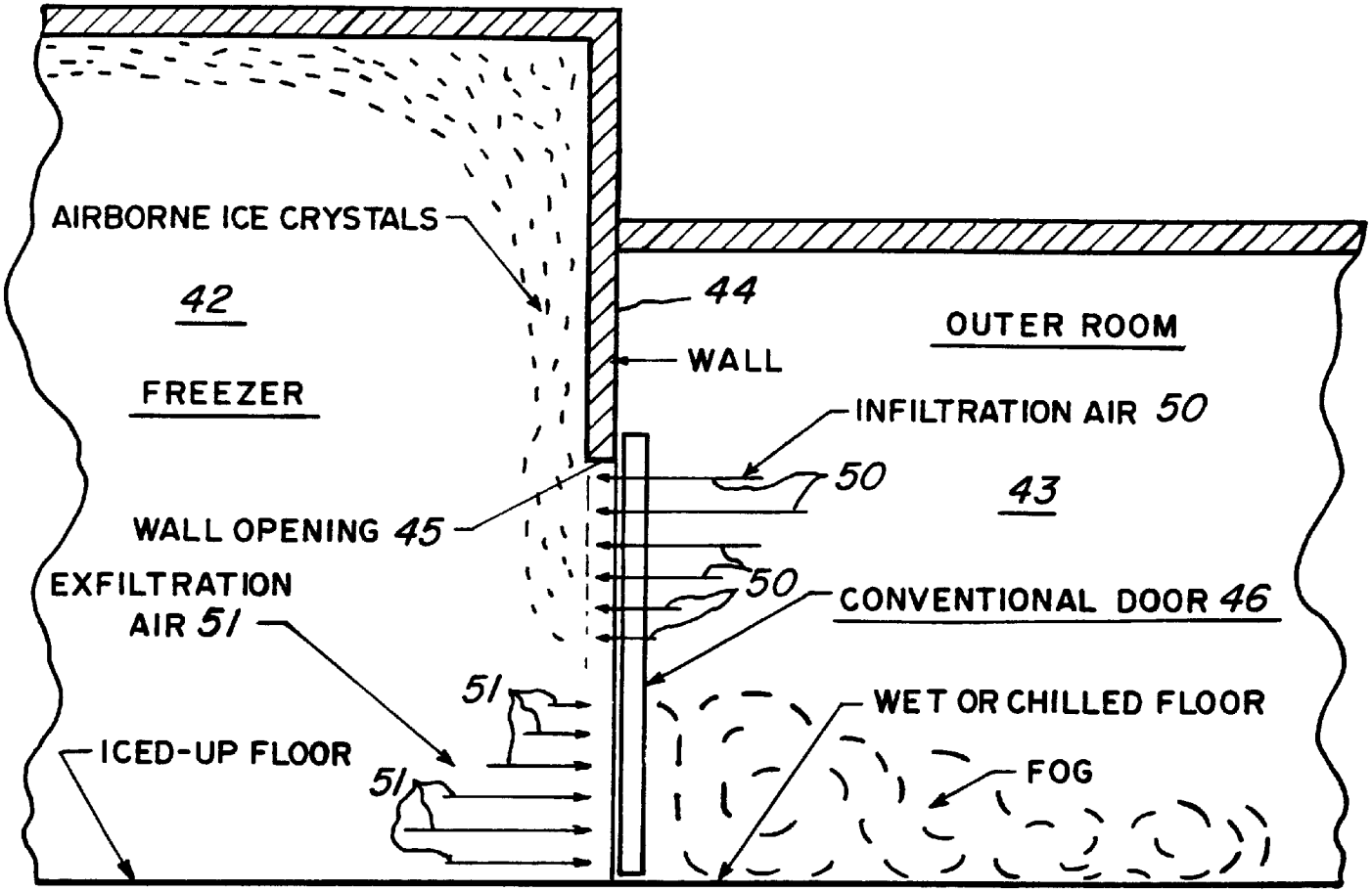
FIG. 4 (PRIOR ART)
FIG. 4 is a diagram showing a cross-section of a structure including a freezer or cold storage room and an outer room, or anteroom, or loading dock, with a doorway provided in a wall of the freezer leading to the outer or anteroom.

FIG. 4 is helpful for understanding the physics associated with the aforementioned problems associated with a doorway or other opening in a wall of a refrigerated warehouse. A freezer room 42 has an associated outer or anteroom 43 with a wall 44 positioned between the two rooms. A wall opening such as a doorway 45 may be adapted to be closed off selectively by a conventional door 46. Whenever the door is open (a frequent occurrence for a busy warehouse) relatively warm, humid and light air 50 infiltrates from the anteroom 43 into the freezer room 42 through the top portion opening 45 while simultaneously relatively heavy, cold air 51 is exfiltrated from the freezer room into the anteroom through the lower half of the opening. This problem is well understood and the consequences of the infiltration and the exfiltration are very significant. As indicated above, the light, moist air infiltrated into the freezer room forms airborne ice crystals which can fall onto the floor to create dangerous icy and slippery floors; the ice crystals also can cause ice to be formed on the walls and the goods which are being stored in the warehouse; thus a hazardous working environment as well as damage to the goods can be created.

Concurrently, the heavy, cold air exfiltrated from the freezer room through the open doorway or opening can create a substantial amount of fog in the anteroom zone which creates an additional hazard for personnel. Also, the floor in the anteroom may become wet and slippery; another hazard.

Figure 4A:
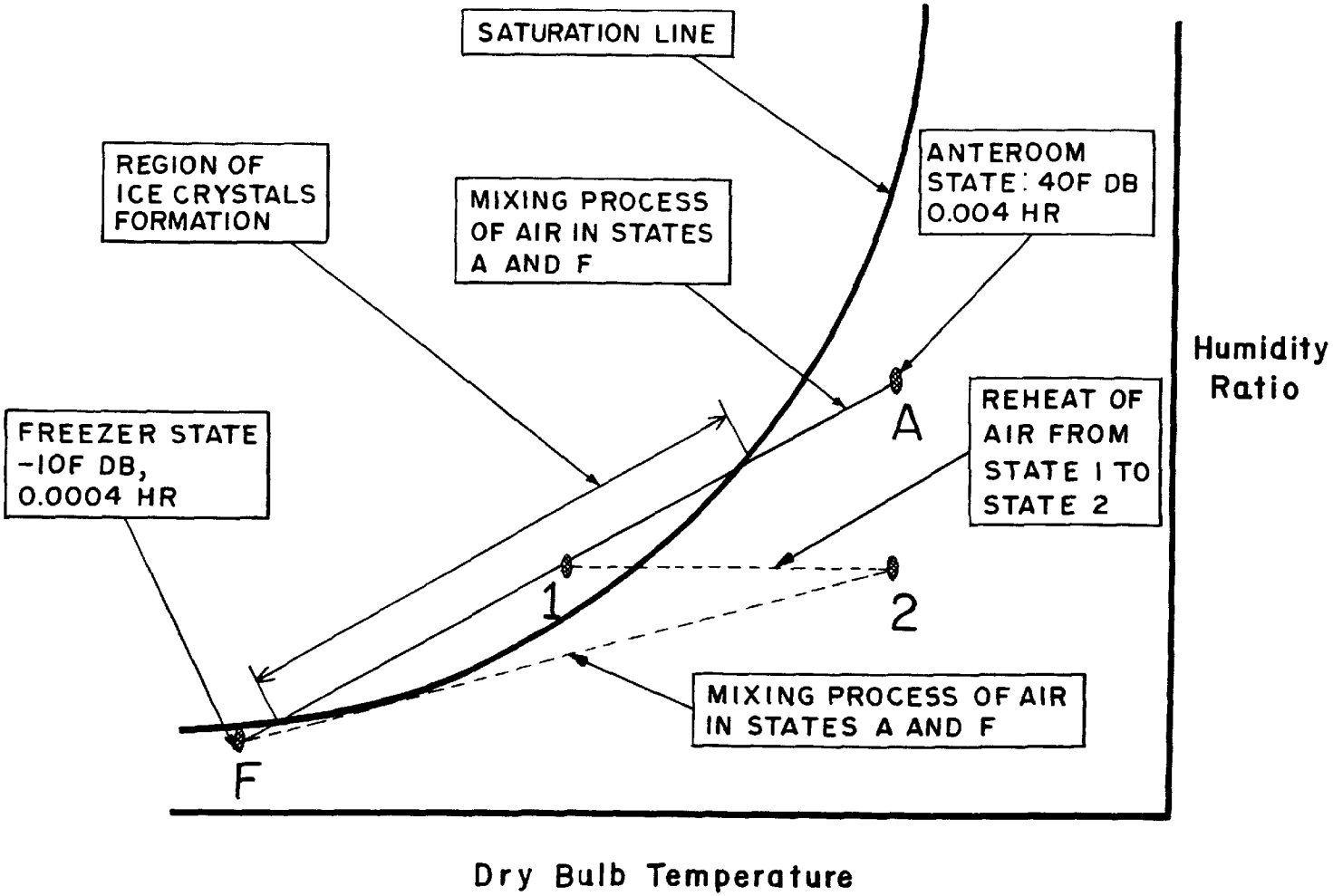
FIG. 4A (PRIOR ART)
FIG. 4*a* is a psychrometric chart of standard form with dry-bulb air temperature and air humidity ratio on the X and Y axes respectively, and with a saturation line depicted.

FIG. 4A shows a psychrometric chart which will be understood by those skilled in the art to correlate the above-described actions of FIG. 4 with respect to the formation of the airborne ice crystals in the freezer room 42.

Figure 5:
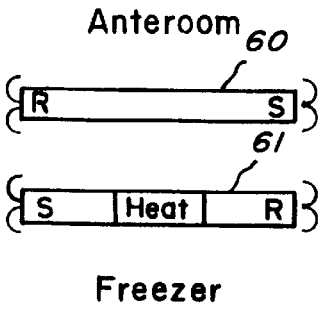
FIG. 5 (PRIOR ART)
FIG. 5 is a schematic showing a prior art double-air curtain with heat.

FIG. 5 is a schematic of a prior art double-air-curtain apparatus, i.e., air curtains 60 and 61 arranged to form a vestibule associated with an opening in a wall of a freezer room (not shown). Air curtain 60 has supply and return manifolds S and R on the right and left respectively as shown. The nomenclature R and S being used both for this figure as well as for FIGS. 6–13 to designate, respectively, return air manifolds and supply manifolds. It will be further noted that the air curtain 61 has manifolds which are the reverse of air curtain 60, i.e., the return manifold is on the right and the supply manifold is on the left as depicted. The prior art arrangement shown in FIG. 5 had a certain level of effectiveness for reducing the aforesaid problems of icing, fog, and energy consumption, but has not proven fully satisfactory from the standpoint of operating cost.

Figure 6:
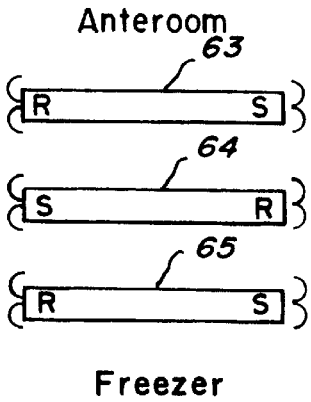
FIG. 6 depicts schematically one embodiment of my invention, comprising three or more air curtains arranged in a vestibule.

FIG. 6 depicts a first embodiment of my invention, namely a multiple air curtain apparatus for controlling and conditioning the flow of air through an opening in a vertical wall of a cold storage room and comprising at least three air curtain units arranged in aligned, spaced-apart and substantially parallel relationship to form a vestibule positioned adjacent to and in register with the wall opening. In FIG. 6, three air curtains 63, 64 and 65 are arranged in aligned, spaced-apart and substantially parallel relationship to form a vestibule positioned adjacent to and in register with the opening (not shown). It will be noted from FIG. 6 that the return and supply manifolds are alternated. Thus the return manifold of air curtain 63 is proximate or adjacent to the supply manifold at the left end of air curtain 64. Further, the return manifold for air curtain 65 is at the left end thereof as shown, and so forth. Significant economic advantage is derived from using the invention depicted in FIG. 6; this configuration of three or more air curtains has been found to significantly reduce the amount of warm moist air infiltrating into the freezer room and to simultaneously reduce the amount of cold air exfiltrating from the freezer room and to lower the operating cost.

Figure 7:
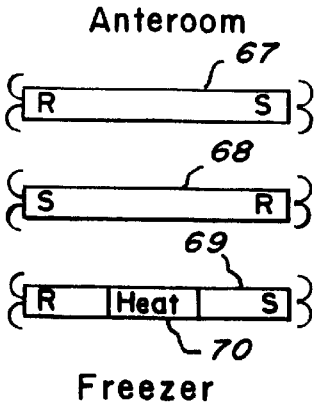
FIGS. 7, 8 and 9 are schematics depicting another embodiment of my invention comprising three or more air curtains arranged in vestibules with at least one of the vestibules having auxiliary heat means for heating the air supplied to the supply duct or manifold of the air curtain.
Figure 8:
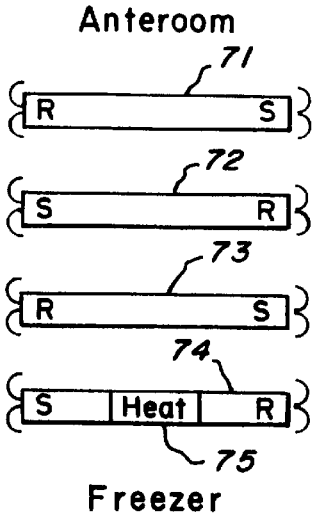
Figure 9:
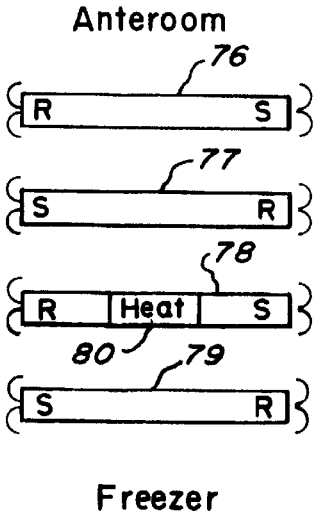

A second embodiment of my invention is depicted in FIGS. 7, 8 and 9 wherein a plurality of at least three air curtain units are arranged in aligned, spaced-apart and substantially parallel relationship to form a vestibule positioned adjacent to and in register with the wall opening (not shown). The difference between this embodiment and the embodiment shown in FIG. 6 is that a heat stage is provided for one (or more) of the air curtain units. Thus, in FIG. 7 three air curtain units 67, 68 and 69 are provided, with the heating means being associated with air curtain 69 most proximate to the freezer room. The heating means is identified by reference numeral 70 for the apparatus depicted schematically in FIG. 7.

FIG. 8 depicts four air curtains, 71, 72, 73 and 74 arranged in a vestibule with air curtain 74 having heating means 75 associated therewith proximate to the freezer room. An optional arrangement from that shown in FIG. 8 is depicted in FIG. 9 wherein four air curtains 76, 77, 78 and 79 are arranged in a vestibule and with heating means 80 being associated with air curtain 78.

A third embodiment of my invention is depicted in the schematic representation shown in FIGS. 10, 11, 12 and 13; these configurations can be characterized as at least two air curtain units arranged in aligned, spaced-apart and substantially parallel relationship to form a vestibule positioned adjacent to and in register with a wall opening, and further characterized by one of the air curtains associated therewith having heating means for heating the air which is discharged from the air discharge means of the supply manifold, and further comprising cooling means associated with another of the air curtains in the vestibule for cooling the air being discharged from the air discharge means of the air supply manifold. The aforementioned heating and cooling functions are preselected with respect to the locations of the anteroom and the freezer room so as to significantly reduce the amount of water vapor infiltrated into the freezer room.

Figure 10:
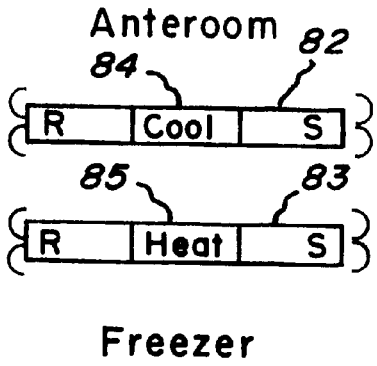
FIGS. 10, 11, 12 and 13 depict schematically another embodiment of my invention comprising two or more air curtains with heat being supplied to the supply manifold of one of the air curtains and with another of the air curtains having auxiliary air cooling means for supplying cooled air to the supply manifold thereof.

FIG. 10 depicts a pair of air curtains 82 and 83 having respectively cooling and heating means 84 and 85.

Figure 11:
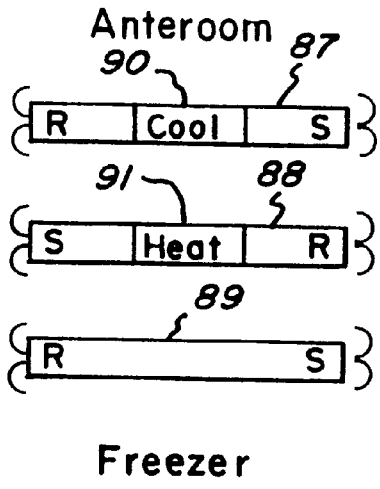

FIG. 11 shows three air curtains 87, 88 and 89 arranged to form a vestibule, and air curtains 87 and 88 have respectively associated therewith cooling means 90 and heating means 91.

Figure 12:
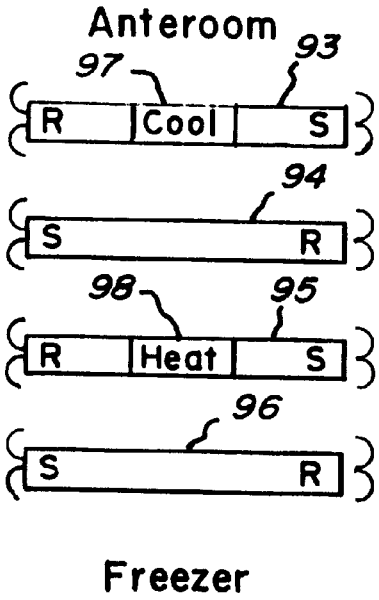

FIG. 12 shows four air curtains 93, 94, 95, and 96 arranged to form a vestibule and air curtains 93 and 95 have associated therewith respectively cooling means 97 and heating means 98.

Figure 13:
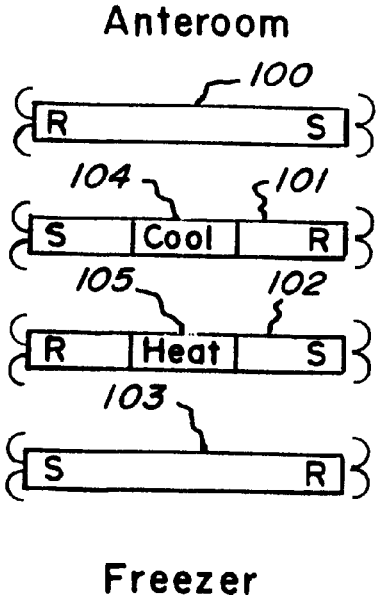

FIG. 13 depicts four air curtains 100, 101, 102 and 103 arranged to form a vestibule and air curtains 101 and 102 have respectively cooling means 104 and heating means 105.

It will be noted in the systems depicted in FIGS. 10, 11 and 12 that the cooling means is associated with the air curtain most proximate to the anteroom; the function of the cooling of the air being discharged by the supply manifold is to remove moisture from the air infiltrating into the freezer room. Thus, it is usually most efficient to have the "cooling" air curtain closest to the anteroom. The arrangement shown in FIG. 13 is a modification of this principal wherein the cooling function is in the second air curtain spaced away from the anteroom. It will be noted, however, that for all variations of this embodiment of the invention, as exemplified by FIGS. 10–13, the air curtain which includes the heating function is always positioned between the wall opening and the air curtain having the cooling function. Stated otherwise, the progression is from the anteroom, the cooling function, the heating function and, finally, the freezer room.

Figure 14:
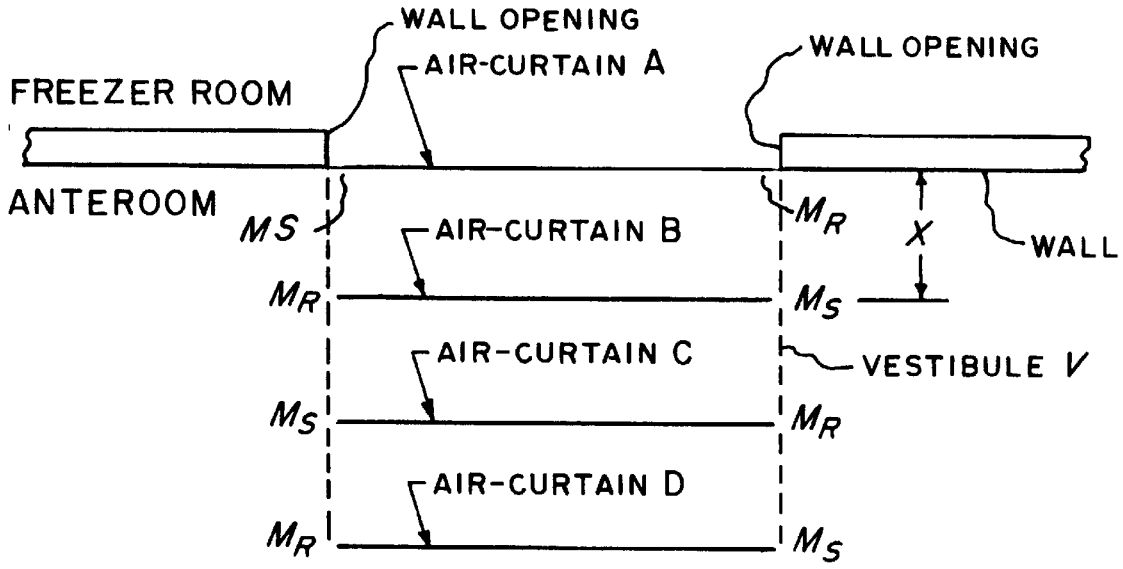
FIG. 14 is a schematic diagram of a vestibule comprising four separate spaced-apart air curtains, A, B, C and D showing one possible orientation of the vestibule with respect to the opening in the wall between the anteroom and freezer, and also showing how the supply ($M_S$) and return ($M_R$) ducts or manifolds are alternated in the vestibule.

FIG. 14 depicts a plurality of air curtains A, B, C and D arranged in aligned, spaced-apart and substantially parallel relationship to form a vestibule positioned adjacent to and in register with the depicted wall opening in a wall positioned between a freezer room and an anteroom. It will be understood that some means such as a sidewall SW depicted in FIG. 1 would be provided between the air curtains to prevent air from the sides of the vestibule infiltrating into the inner passageway of the vestibule. It should also be understood that the schematic arrangement shown in FIG. 14 is applicable to the arrangements depicted in FIGS. 5–13.

Figure 16:
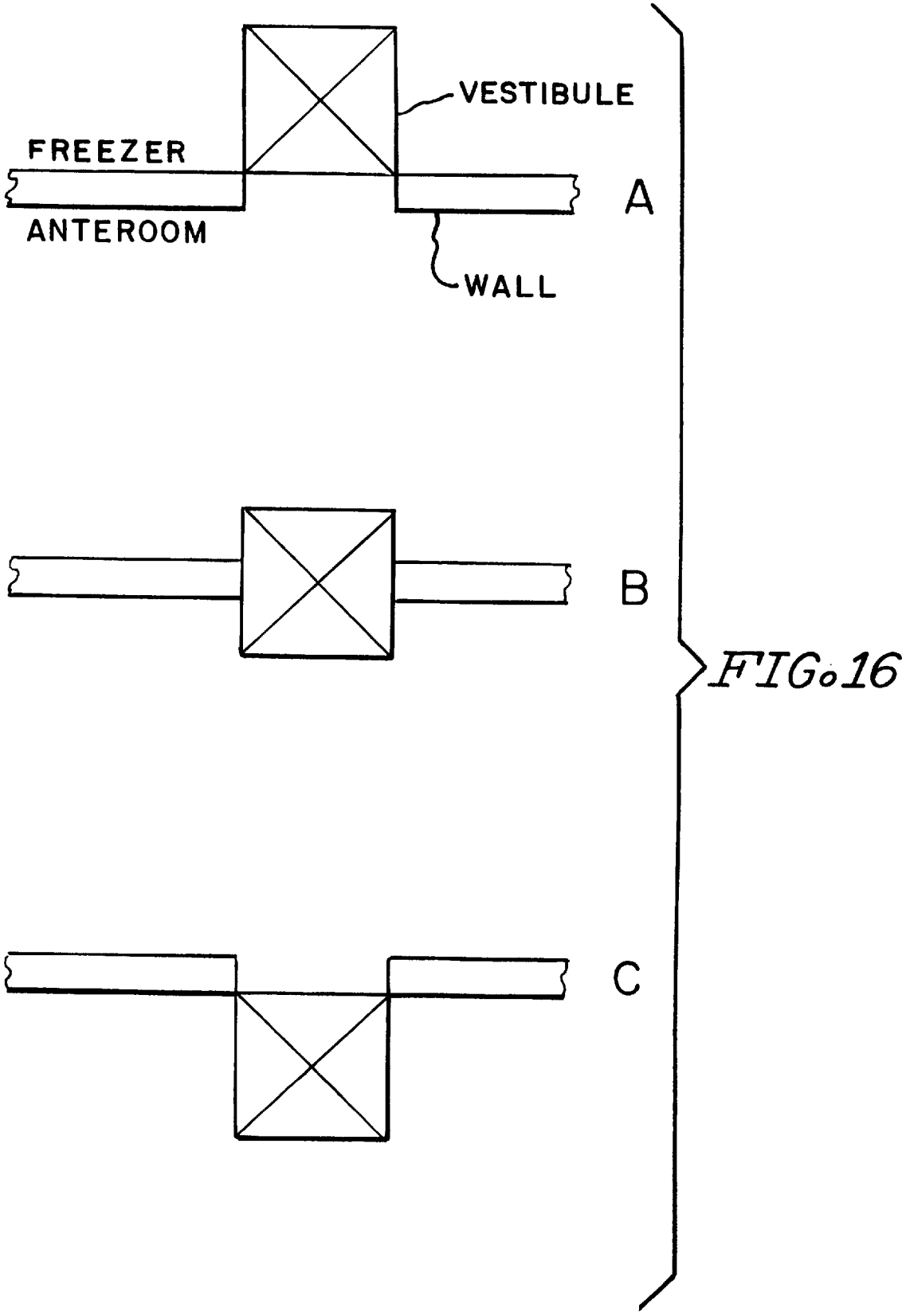
FIG. 16 shows three possible orientations of the vestibule with respect to the opening in the wall between the anteroom and freezer.

FIG. 16 shows schematic variations of the relationship of the vestibule with respect to the wall between the freezer and the anteroom. In FIG. 16A, the vestibule (which should be understood to comprise at least two air curtain units) is positioned substantially within the freezer room and with the air curtain units being arranged in aligned, spaced-apart and substantially parallel relationship, and in register with the opening in the wall. The arrangement shown in FIG. 16B has the vestibule positioned so as to straddle the wall opening and the arrangement in FIG. 16C has the vestibule positioned substantially in the anteroom but adjacent to the opening.

Figure 15:
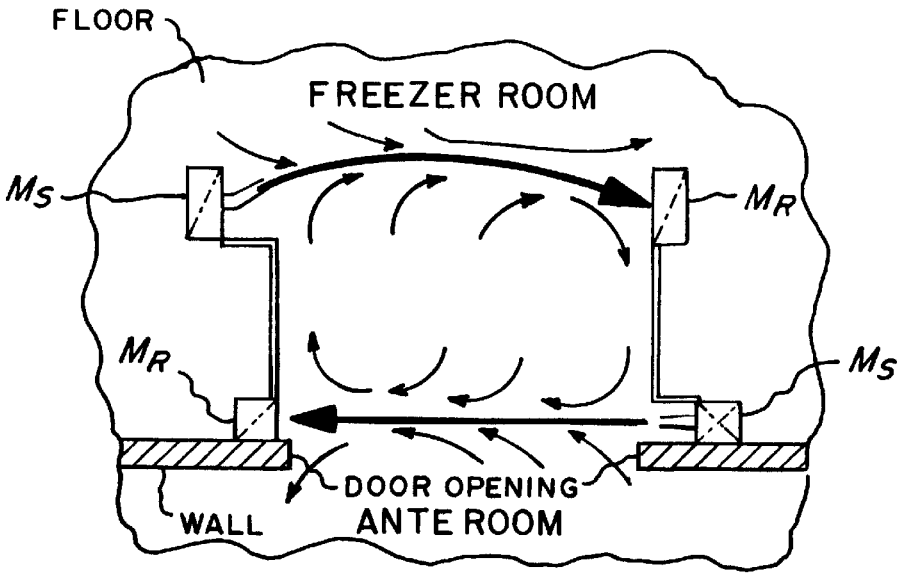
FIG. 15 is a schematic showing a double curtain air unit with heavy arrows showing primary airflow and lighter arrows showing secondary airflow.

In FIG. 15, a double air curtain is shown in plan view, with the heavy arrows showing primary airflow from the supply manifolds to the return manifolds and the lighter arrows show a secondary airflow which, as depicted, is shown to have a clockwise vortex-like action or flow.

Figure 17:
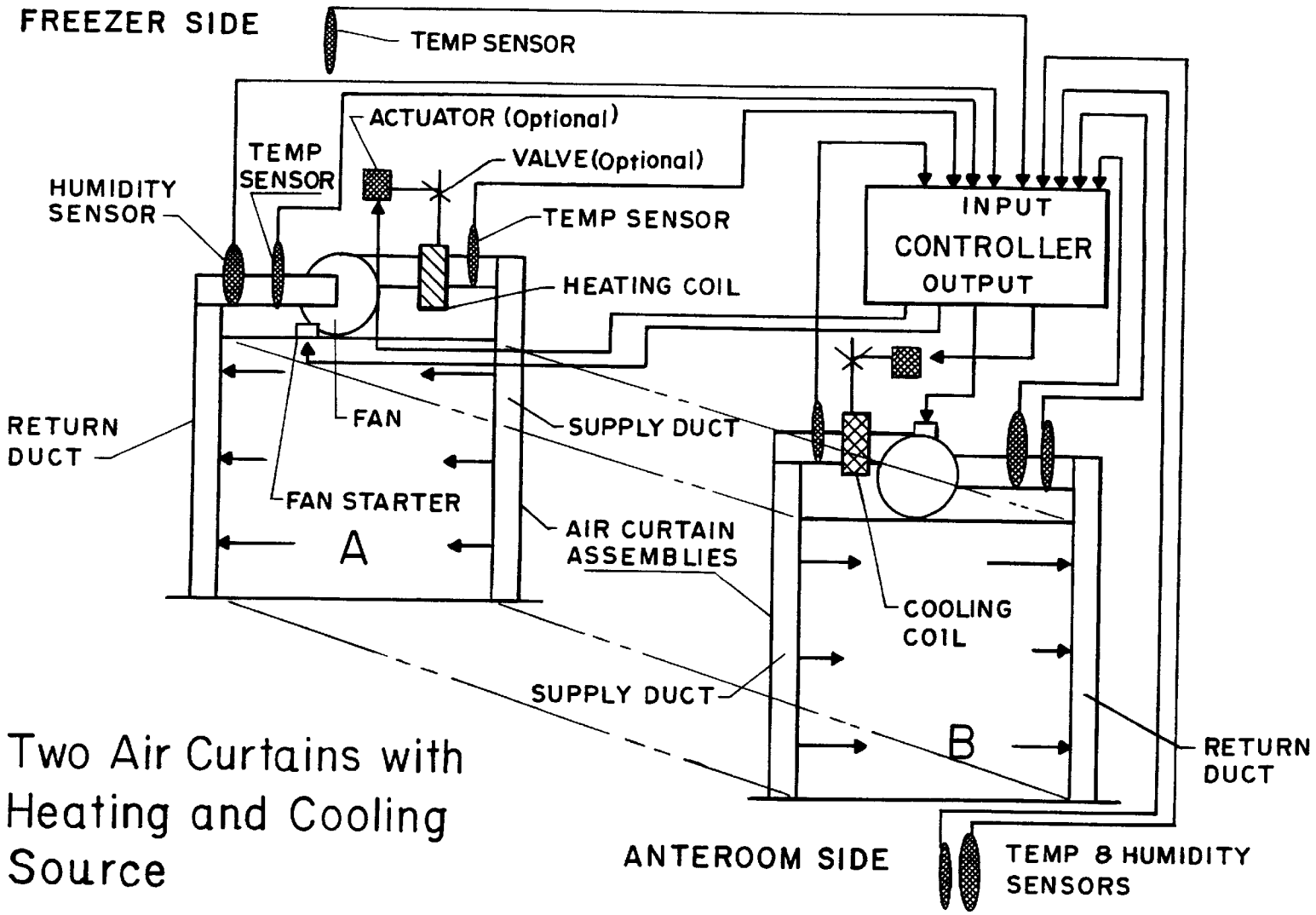
FIG. 17 is an isometric schematic of a dual air-curtain apparatus with heating and cooling, and with the control means for controlling the heating and the cooling of the air being supplied to the supply duct of the two air curtains respectively.

FIG. 17 is an isometric depiction of a double air curtain embodiment of the invention having both the heating and cooling function, the air curtains being identified by references A and B. Air curtain A is positioned most adjacent to the freezer side of the vestibule and comprises the elements labeled in the figure which include a return duct and supply duct connected, as described above, with a motor driven fan. It should be specifically noted that a heating coil or heating means is inserted in the ductwork connecting the fan to the supply duct.

Likewise, the air curtain B has a supply duct and a return duct, and a motor driven fan, a cooling coil being provided to cool the pressurized air being transferred from the fan to the supply duct. FIG. 17 may be considered to be a depiction of the cooling coil and the heating coil being associated with a heat pump.

While a preferred embodiment of the invention has been illustrated, it will be understood that variations may be made by those skilled in the art without departing from the inventive concept. Accordingly, the invention is to be limited only by the scope of the following claims.

I claim:

1. A multiple air-curtain apparatus for controlling and conditioning the flow of air through an opening in a vertical wall of a cold storage room, said opening having a top, a bottom, and two sides, said apparatus comprising:

at least three air curtain units arranged in aligned, longitudinally spaced-apart and substantially parallel relationship to form an inverted U-shaped vestibule positioned adjacent to and in register with said opening, said vestibule having a top, a bottom, and two opposed sides, each of said units comprising (1) first and second vertically oriented air manifold members respectively positioned adjacent said opposed sides of said vestibule and extending from said bottom to said top of said vestibule, said first manifold member being an air discharge means including longitudinally-disposed, laterally-positionable directional blades arranged from the top to the bottom thereof, and said second manifold member being an air return means and having air inlet means disposed from the top to the bottom thereof, and (2) air transport means including air blower means connected to said first manifold member and adapted supply pressurized air thereto, and further including air return means connecting said second manifold member to inlet means of said blower means, said apparatus being further characterized by:

a) said air curtain units being arranged so that their respective first manifold members are proximate or adjacent to the second manifold members of the next adjacent air curtain units; and b) said blades of said first manifold members being preselectively sized and set and directed as follows:

i) said blades at the top of said first manifold members are sized and are set at a preselected maximum orientation away from said room to provide maximum discharged air momentum countering relatively warm and moist air flow through said vestibule and thence through said opening into said room;

ii) said blades at the bottom of said first manifold members are sized and are set at a preselected maximum orientation toward said cold storage room to provide maximum discharged air momentum countering relatively heavy cold air flow from said room through said opening; and iii) said blades, on a preselected graduated basis, are sized and set so that the blades, at a preselected intermediate position, have (1) an orientation toward said second manifold members; and (2) a reduced preselected discharged air momentum;

whereby said apparatus is operable to counter and condition the flow of heavier cold air from said cold storage room through the bottom of said opening and the flow of relatively warm and lighter air into said cold storage room through the top of said opening by the re-circulation of pressurized air from said blower means, through said blades, thence horizontally to said air inlet means of said second manifold members, and thence via said air return means to said inlet means of said blower means.

2. A multiple air-curtain apparatus for controlling and conditioning the flow of air through an opening in a vertical wall of a cold storage room, said opening having a top, a bottom, and two sides, said apparatus comprising:

at least three air curtain units arranged in aligned, longitudinally spaced-apart and substantially parallel relationship to form an inverted U-shaped vestibule positioned adjacent to and in register with said opening, said vestibule having a top, a bottom, and two opposed sides, each of said units comprising (1) first and second vertically oriented air manifold members respectively positioned adjacent said opposed sides of said vestibule and extending from said bottom to said top of said vestibule, said first manifold member being an air discharge means including longitudinally-disposed, laterally-positionable directional blades arranged from the top to the bottom thereof, and said second manifold member being an air return means and having air inlet means disposed from the top to the bottom thereof, and (2) air transport means including air blower means connected to said first manifold member and adapted supply pressurized air thereto, and further including air return means connecting said second manifold member to inlet means of said blower means, said apparatus being further characterized by:

a) said air curtain units being arranged so that their respective first manifold members are proximate or adjacent to the second manifold members of the next adjacent air curtain units;

b) said blades of said first manifold members being preselectively sized and set and directed as follows:

i) said blades at the top of said first manifold members are sized and are set at a preselected maximum orientation away from said room to provide maximum discharged air momentum countering relatively warm and moist air flow through said vestibule and thence through said opening into said room;

ii) said blades at the bottom of said first manifold members are sized and are set at a preselected maximum orientation toward said cold storage room to provide maximum discharged air momentum countering relatively heavy cold air flow from said room through said opening; and iii) said blades, on a preselected graduated basis, are sized and set so that the blades, at a preselected intermediate position, have (1) an orientation toward said second manifold members; and (2) a reduced preselected discharged air momentum; and c) the air transport means for one of said air curtain units including means for heating the pressurized air supplied to the first manifold means thereof;

whereby said apparatus is operable to counter and condition the flow of heavier cold air from said cold storage room through the bottom of said opening and the flow of relatively warm and lighter air into said cold storage room through the top of said opening by the re-circulation of pressurized and heated air from said blower means, through said blades, thence horizontally to said air inlet means of said second manifold members, and thence via said air return means to said inlet means of said blower means.

3. A multiple air-curtain apparatus for controlling and conditioning the flow of air through an opening in a vertical wall of a cold storage room, said opening having a top, a bottom, and two sides, said apparatus comprising:

at least two air curtain units arranged in aligned, longitudinally spaced-apart and substantially parallel relationship to form an inverted U-shaped vestibule positioned adjacent to and in register with said opening, said vestibule having a top, a bottom, and two opposed sides, each of said units comprising (1) first and second vertically oriented air manifold members respectively positioned adjacent said opposed sides of said vestibule and extending from said bottom to said top of said vestibule, said first manifold member being an air discharge means including longitudinally-disposed, laterally-positionable directional blades arranged from the top to the bottom thereof, and said second manifold member being an air return means and having air inlet means disposed from the top to the bottom thereof, and (2) air transport means including air blower means connected to said first manifold member and adapted supply pressurized air thereto, and further including air return means connecting said second manifold member to inlet means of said blower means, said apparatus being further characterized by:

a) said air curtain units being arranged so that their respective first manifold members are proximate or adjacent to the second manifold members of the next adjacent air curtain units;

b) said blades of said first manifold members being preselectively sized and set and directed as follows:

i) said blades at the top of said first manifold members are sized and are set at a preselected maximum orientation away from said room to provide maximum discharged air momentum countering relatively warm and moist air flow through said vestibule and thence through said opening into said room;

ii) said blades at the bottom of said first manifold members are sized and are set at a preselected maximum orientation toward said cold storage room to provide maximum discharged air momentum countering relatively heavy cold air flow from said room through said opening; and iii) said blades, on a preselected graduated basis, are sized and set so that the blades, at a preselected intermediate position, have (1) an orientation toward said second manifold members; and (2) a reduced preselected discharged air momentum;

c) the air transport means for one of said air curtain units including means for heating the pressurized air supplied to the first manifold member thereof; and d) the air transport means for another of said air curtain units including means for cooling the pressurized air supplied to the first manifold member thereof, said one of said air curtain units being positioned between said opening and said another of said air curtain units;

whereby said apparatus is operable to counter and condition the flow of heavier cold air from said cold storage room through the bottom of said opening and the flow of relatively warm and lighter air into said cold storage room through the top of said opening by the re-circulation of pressurized and heated and cooled air from said blower means, through said blades, thence horizontally to said air inlet means of said second manifold means, and thence via said air return means to said inlet means of said blower means.

4. Apparatus of either claim 1, 2, or 3, further characterized by said air curtain units being spaced apart horizontally approximately one foot for each two feet of distance of separation between the first and second vertically-oriented air manifold members.

5. Apparatus of claim 3 wherein said heating and cooling means are a heat pump means.

* * * * *